United States Patent [19]

Bielli et al.

[11] 4,263,599

[45] Apr. 21, 1981

[54] PARABOLIC REFLECTOR ANTENNA FOR TELECOMMUNICATION SYSTEM

[75] Inventors: Paolo Bielli, Cirie'-Torino; Salvatore De Padova, Turin, Italy

[73] Assignee: CSELT-Centro Studi e Laboratori Telecomunicazioni S.p.A., Turin, Italy

[21] Appl. No.: 37,470

[22] Filed: May 9, 1979

[30] Foreign Application Priority Data

May 11, 1978 [IT] Italy ..... 68089 A/78

[51] Int. Cl.[3] ..... H01Q 19/13

[52] U.S. Cl. ..... 343/781 R; 343/786

[58] Field of Search ..... 343/786, 840, 781 R, 343/781 P

[56] References Cited

U.S. PATENT DOCUMENTS

| | | | |
|---|---|---|---|
| 3,599,219 | 8/1971 | Holtum | 343/840 |
| 3,696,435 | 10/1972 | Zucker | 343/840 |
| 3,740,755 | 6/1973 | Grenzebeck | 343/840 |
| 3,864,688 | 2/1975 | Hansen et al. | 343/840 |

OTHER PUBLICATIONS

Ludwig; IEEE Transactions on Antennas and Propagation, Jan. 1973, pp. 116–119.

Bielli et al.; Feed Design Method for Reflector Antennas CSELT, No. 2, Sep. 1974, pp. 19–24.

Bielli et al.; "Proceedings of the Sixth Colloquium on Microwave Communication", Budapest, Aug. 29, 1978–Sep. 1, 1978, vol. I, III–6/37.1–III–6/37.4.

*Primary Examiner*—Eli Lieberman

*Attorney, Agent, or Firm*—Karl F. Ross

[57] ABSTRACT

A parabolic reflector antenna, designed to discriminate between incoming and outgoing waves having mutually orthogonal planes of polarization, has a ratio R between focal distance f and diameter D which, for optimum efficiency and cross-polarization decoupling, lies between 0.46 and 0.5 and operation in the $TE_{11}$ mode and above 0.6 for operation in the dual $TE_{11}+TM_{11}$ mode. An associated feed, in the shape of a slightly tapering horn of circular cross-section connected to a waveguide of square cross-section, has a relative aperture $\alpha$, defined as the ratio between its aperture radius r and the wavelength $\lambda_o$ at the center of the operating frequency band, which in the first instance ranges between 0.52 and 0.6 and in the second instance is given by $kR+h$ with $k \approx 1$ and h between about 0.1 and 0.15.

4 Claims, 6 Drawing Figures

PARABOLIC REFLECTOR ANTENNA FOR TELECOMMUNICATION SYSTEM

FIELD OF THE INVENTION

Our present invention relates to a parabolic reflector antenna designed to be used in a telecommunication system.

BACKGROUND OF THE INVENTION

For two-way transmission of messages between two stations equipped with such antennas it is convenient to use mutually orthogonal planes of polarization for incoming and outgoing waves lying within a common frequency band. An essential requirement in such a case is the minimization of cross-coupling between the two types of polarization; this calls for an effective suppression of side lobes in the radiation pattern. A high efficiency in both transmission and reception is, of course, also required.

In so-called front-fed antennas, an important design parameter from the viewpoint of efficiency is the ratio $R=f/D$ where f is the focal distance and D is the diameter of the paraboloidal reflector surface. Conventional means for the suppression of side lobes include the provision of an absorbent collar peripherally surrounding the reflector to reduce so-called spillover.

The cross-polarization field $E_x$ is generally given by the expression $$E_x = \sin 2\Phi_p \cos^2 \frac{\Theta_p}{2} \int_0^1 g(\alpha,R,\Theta_p,\rho)d\rho \quad (1)$$

where $\rho$ is the radial variable used for integrating the field over the reflector surface, $\Theta_p$ and $\Phi_p$ are angular coordinates determining the field of radiation, and $\alpha$ is the relative aperture of the feed given by $r/\lambda_o$, r being the radius of the feed aperture confronting the reflector and $\lambda_o$ being the median wavelength at the center of the band of operating frequencies. Function g will be described in greater detail hereinafter.

Thus, effective suppression of cross-coupling requires substantial elimination of the field $E_x$.

In a paper entitled "Feed Design and Method for Reflector Antennas", presented by us at the European Microwave Conference held in Brussels in September 1973, we have discussed the relationship of the efficiency of a front-fed parabolic antenna and the aforementioned parametric ratio $R=f/D$. We have since determined, however, that the conditions for maximum antenna efficiency $\eta$ do not yield the best results for the elimination of cross-coupling between waves polarized in mutually orthogonal (e.g. horizontal and vertical) planes.

OBJECTS OF THE INVENTION

The general object of our present invention, therefore, is to provide an improved antenna structure of the type referred to which satisfies the requirements for high efficiency and minimum cross-coupling at the same time.

A more particular object of our invention is to provide an optimum antenna design for waves propagating in either the unitary $TE_{11}$ mode or the dual $TE_{11}+TM_{11}$ mode.

SUMMARY OF THE INVENTION

We have found that, in accordance with a feature of our invention applicable in particular to the unitary $TE_{11}$ mode of propagation, the ratio $R=f/D$ of the reflector should range between 0.46 and 0.5 while the ratio $\alpha=r/\lambda_o$ of the feed ranges between 0.52 and 0.6 for optimum performance.

We have further found that, pursuant to another feature of our invention applicable in particular to the dual mode $TE_{11}+TM_{11}$, the ratio R should exceed 0.6 while the ratio $\alpha$ is at least equal to 0.7.

BRIEF DESCRIPTION OF THE DRAWING

The above and other features of our invention will now be described in detail with reference to the accompanying drawing in which.

SPECIFIC DESCRIPTION

Figure 1:
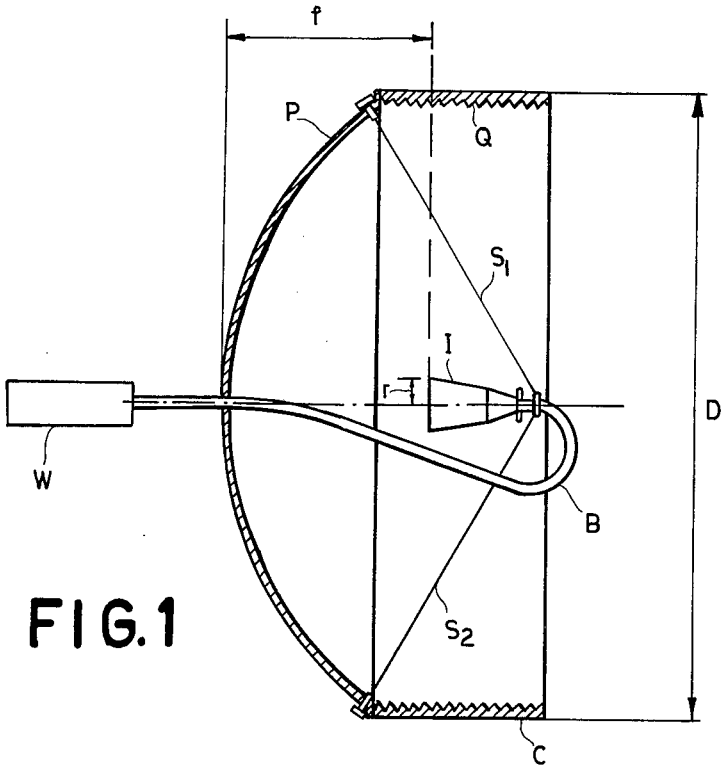
FIG. 1 is an axial sectional view of a reflector antenna according to our invention.
Figure 1A:
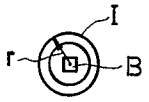
FIG. 1A is a face view of a feed forming part of the antenna structure of FIG. 1.

In FIG. 1 we have shown a paraboloidal reflector P confronting a feed I in the shape of a horn, also shown in FIG. 1A, which is of circular cross-section and slight taper so as to be nearly cylindrical. The axis of horn I coincides with that of reflector P and the center of its aperture, of radius r, coincides with the focus of the paraboloid having a distance f from the reflector vertex. The rim of the reflector has a diameter D and is joined to a collar C lined with absorbent material Q for the prevention of spillover as is well known per se. Two stays $S_1$, $S_2$ hold the horn I in its illustrated position relative to the reflector.

A waveguide B, which is of square cross-section as seen in FIG. 1A, links the horn I with a duplexer W serving to separate differently polarized incoming and outgoing waves in the usual manner. A source of such waves and a receiver therefor, both not shown, communicate with that duplexer. Thus, the antenna of FIG. 1 forms part of a radio link in a telecommunication network including another, similar antenna at a nonillustrated remote station.

Figure 2:
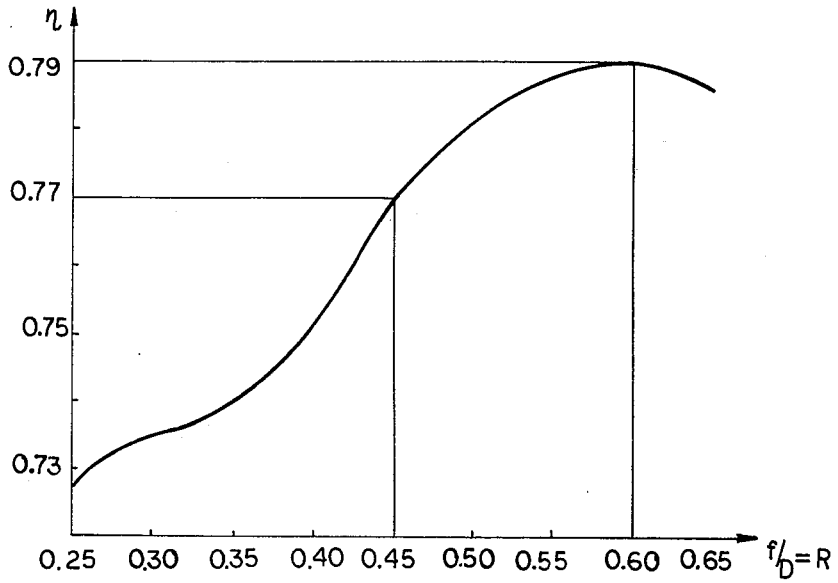
FIG. 2 is a graph showing the relationship between antenna efficiency $\eta$ and ratio R.

In FIG. 2 we have plotted the efficiency $\eta$ of the antenna against its parametric ratio $R=f/D$ for values ranging from $R=0.25$ to $R=0.65$. The efficiency $\eta$ reaches a maximum at $R\approx0.60$.

Figure 3:
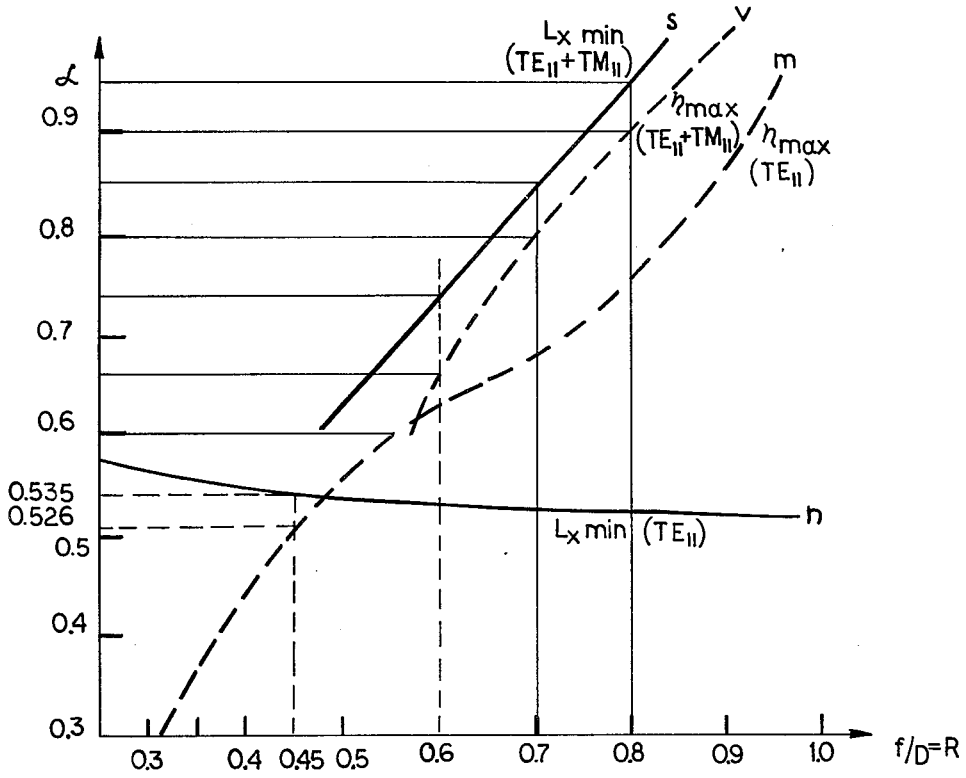
FIG. 3 is a graph with two pairs of curves showing relative aperture $\alpha$ plotted against ratio R for optimum efficiency and decoupling with the unitary $TE_{11}$ mode and the dual $TE_{11}+TM_{11}$ mode.

FIG. 3 shows the relative aperture $\alpha$ plotted against the same ratio R along two curves m and v for maximum efficiency $\eta_{max}$ in the $TE_{11}$ mode and the $TE_{11}+TM_{11}$ mode, respectively; two further curves n and s respectively represent, for the same two modes, the relationship of $\alpha$ and R under conditions of minimum cross-coupling. It will be noted that the optimum value $R=0.6$ according to FIG. 2 corresponds to different magnitudes of relative aperture $\alpha$ on curves m and n, these two curves intersecting at a point for which R is slightly less than 0.5 and $\alpha$ lies just below 0.535.

Figure 4:
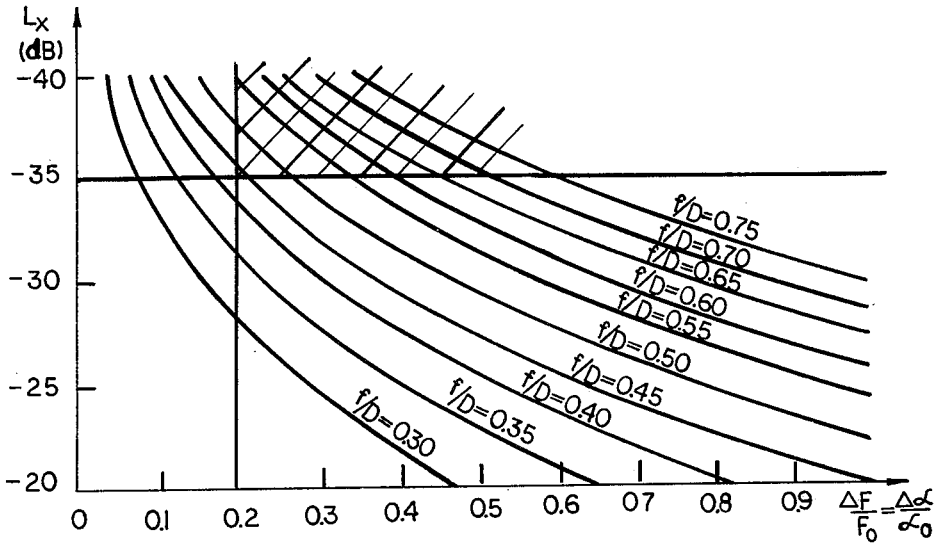
FIG. 4 shows a family of curves representing the relative cross-polarization level $L_x$ plotted against a range of relative apertures for different ratios R.

On the abscissa of FIG. 4 we have indicated a relative bandwidth $\Delta F/F_o=\Delta\alpha/\alpha_o$ where $F_o$ is the midfrequency of a band having a frequency spread $\Delta F$ while $\alpha_o$ denotes the relative aperture $\alpha$ under conditions of minimum cross-coupling (curve n of FIG. 3). The several curves of FIG. 4 show the cross-polarization level $L_x$ (referred to the level of direct polarization) for various values of $R=f/D$ ranging between 0.30 and 0.75. For a bandwidth of half an octave, i.e. $\Delta F/F_o=0.5$, a reflector of parametric ratio $R\geqq 0.4$ shows a level difference of better than 25 dB; with $R\geqq 0.6$ the decoupling improves to a level difference well above 30 dB. Such a large bandwidth, however, is rarely used in practice. From a structural viewpoint, moreover, it is desirable to keep the ratio R as low as possible.

Figure 5:
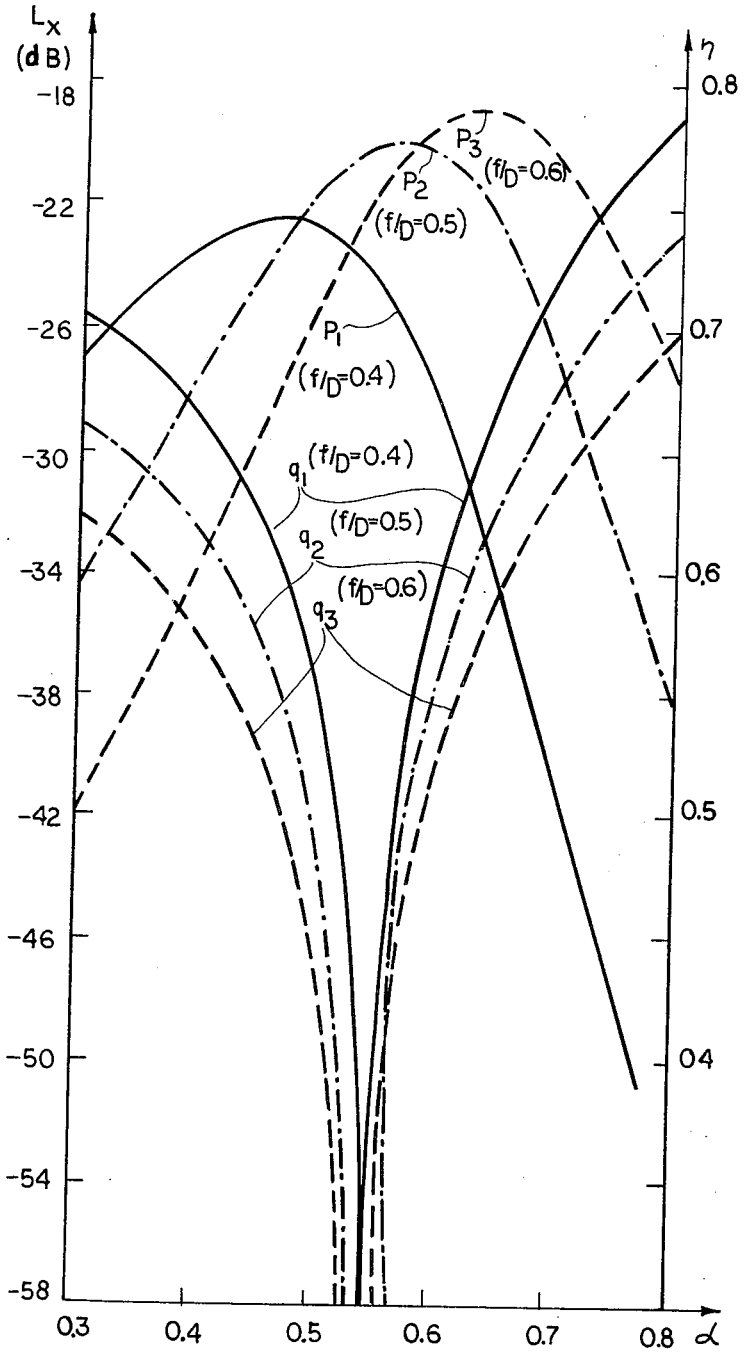
FIG. 5 represents two further families of curves showing level $L_x$ and efficiency $\eta$ plotted against relative aperture $\alpha$ for different ratios R.

Thus, we have particularly indicated in FIG. 4 a relative bandwidth of 0.2 corresponding to limiting frequencies which differ from the midfrequency $F_o$ by $\pm 10\%$. In this case, using a level $L_x=-35$ dB as a threshold to delineate a useful area shown hatched in FIG. 4, we find that parametric ratios R upwards of 0.45 are suitable. The value of $R=0.45$ corresponds in FIG. 3 to a value of $\alpha=0.526$ for optimum efficiency (curve m) and an only slightly different value of $\alpha=0.535$ for optimum decoupling (curve n); a suitable compromise between efficiency and decoupling may be adopted with the aid of curves such as those shown at $p_1-p_3$ and $q_1-q_3$ in FIG. 5. Curves $p_1$, $p_2$ and $p_3$ represent efficiency $\eta$ plotted against relative aperture $\alpha$ for ratios $R=0.4$, 0.5 and 0.6, respectively; curves $q_1$, $q_2$ and $q_3$ respectively represent relative level $L_x$ plotted against $\alpha$ for the same parametric ratios R.

The foregoing discussion relates to operation in the sole mode $TE_{11}$. With the dual mode $TE_{11}+TM_{11}$, curves s and v of FIG. 3 show a different relationship of optimum values for $\alpha$ and R. Thus, it will be noted that curves s and v are almost linear and nearly parallel for $R>0.6$ so that, in first approximation, we can write $\alpha_x=kR+h_1$ and $\alpha_{72}=kR+h_2$ where $\alpha_x$ represents the optimum for decoupling and $\alpha_n$ is the optimum for efficiency. As will be seen from FIG. 3, k approximately equals unity whereas $h_1\approx 0.15$ and $h_2\approx 0.1$ for values of R ranging substantially between $R=0.65$ and $R=0.85$.

Reference may also be made to an article by Arthur C. Ludwig entitled "The Definition of Cross-Polarization" in IEEE Transactions on Antennas and Propagation (1973), AP-21, No. 1, pages 116–119.

The cross-polarization field $E_x$, given in equation (1), can be more particularly defined by $$E_x \sin 2\Phi_p \cos^2\frac{\Theta_p}{2} \int_0^1 [E_\phi(\alpha)\cos\Psi - E_\psi(\alpha)]\cdot J_2(\pi\frac{D}{\lambda}\sin\Theta_p\rho)\sin\Psi\rho d\rho \quad (2)$$

where $$\Psi = \arccos\frac{(4R)^2-\rho^2}{(4R)^2+\rho^2} \quad (3)$$

The variables $E_{104}(\alpha)$ amd $E_{105}(\alpha)$ are the Fourier transforms of the field components present at the feed aperture in terms of the bipolar coordinates $\psi$, $\rho$ and the relative aperture $\alpha$. The term $$J_2(\pi\frac{D}{\lambda}\sin\Theta_p\rho)$$

is the Bessel function with real argument.

In the most unfavorable case, the field $E_x$ (lying in a direction x transverse to the desired direction of polarization y) has its maximum value. This unfavorable condition exists when $\Phi=45°$ so that $\sin 2\Phi_p=1$ while parameter $\Theta_p$ assumes its maximum value $\Theta_M$. The maximum $\Theta_M$ is obtained through differentiation by setting $dE_x/d\Theta_p=0$.

Under the assumed conditions, with substitutions of $\Theta_M$ for $\Theta_p$ in equation (2), solving this equation digitally by computer yields an expression with R, $\alpha$ and the ratio $D/\lambda$ as the only variables. Ratio $D/\lambda$ is determined by the desired antenna gain and affects neither the efficiency $\eta$ nor the cross-coupling due to the first cross-polarization lobe.

For a gain ratio R we have found that the cross-polarization level $L_x$ is defined by $$L_x = 20\log_{10}\frac{E_x}{2\int_0^1 [E_\phi(\alpha)\cos\Psi + E_\psi(\alpha)]\sin\Psi\rho d\rho} \quad (4)$$

where the numerator $E_x$ satisfies equation (2) whereas the denominator represents the field in the direction of maximum gain for which $\Theta_p=0$.

From the foregoing equations we have established an optimum range of relative apertures $\alpha$ between 0.52 and 0.6 for ratios $R=f/D$ varying between 0.46 and 0.50 when transmission and reception are in the sole $TE_{11}$ mode.

The combined mode $TE_{11}+TM_{11}$, calling for ratios R above 0.6, may be used where these relatively large ratios do not cause any structural problems. In that case, within the range referred to above, $\alpha=kR+h$ with $k\approx 1$ and $0.1<h<0.15$.

We claim:

1. In an antenna for a telecommunication system using incoming and outgoing waves which have mutually orthogonal planes of polarization and lie in a common band of operating frequencies with a central wavelength $\lambda_o$, comprising a parabolic reflector with a focal distance f and a diameter D, a feed with an aperture of radius r confronting said reflector, and wave-transmitting means connecting said feed to a source of and a receiver for waves in said band polarized in the $TE_{11}$ mode, the improvement wherein the ratio $R=f/D$ of said reflector ranges between 0.46 and 0.5 while the ratio $\alpha=r/\lambda_o$ of said feed ranges between 0.52 and 0.6 for optimum efficiency and minimum cross-coupling.

2. In an antenna for a telecommunication system using incoming and outgoing waves which have mutually orthogonal planes of polarization and lie in a common band of operating frequencies with a central wavelength $\lambda_o$, comprising a parabolic reflector with a focal distance f and a diameter D, a feed with an aperture of radius r confronting said reflector, and wave-transmitting means connecting said feed to a source of and a receiver for waves in said band polarized in a dual $TE_{11}+TM_{11}$ mode, the improvement wherein the ratio $R=f/D$ of said reflector exceeds 0.6 while the ratio $\alpha=r/\lambda_o$ of said feed is at least equal to 0.7 for optimum efficiency and minimum cross-coupling, and wherein $\alpha=kR+h$ with $k\approx 1$ and $0.1<h<0.15$.

3. An antenna as defined in claims 1 or 2 wherein said wave-transmitting means comprises a waveguide of square cross-section.

4. An antenna as defined in claim 3 wherein said feed is a nearly cylindrical horn of circular cross-section.

* * * * *